United States Patent [19]

Bachot et al.

[11] 4,204,938

[45] May 27, 1980

[54] METHOD OF MAKING POROUS PLASTIC DIAPHRAGMS AND THE RESULTING NOVEL DIAPHRAGMS

[75] Inventors: Jean Bachot, Fontenay-aux-Roses; Pierre Bouy, Enghien-les-Bains; Michel Juillard, Orsay, all of France

[73] Assignee: Rhone-Poulenc Industries, Paris, France

[21] Appl. No.: 924,795

[22] Filed: Jul. 14, 1978

Related U.S. Application Data

[63] Continuation of Ser. No. 686,723, May 17, 1976, abandoned.

[30] Foreign Application Priority Data

Jun. 11, 1975 [FR] France ..... 75 18246

[51] Int. Cl.[2] ..... B29D 27/04

[52] U.S. Cl. ..... 204/252; 204/296; 264/45.3; 264/46.7; 264/127; 264/259; 264/271

[58] Field of Search ..... 264/49, 46.4, 46.7, 264/259, 127, 271, 45.3; 204/296, 252

[56] References Cited

U.S. PATENT DOCUMENTS

| | | | |
|---|---|---|---|
| 3,694,281 | 9/1972 | Leduc | 428/251 X |
| 3,980,613 | 9/1976 | Bachot et al. | 264/49 X |

FOREIGN PATENT DOCUMENTS 7303847 9/1973 France .

*Primary Examiner*—Philip Anderson

[57] ABSTRACT

A novel diaphragm suitable for use in electrolytic cells and a novel method of making the diaphragms are provided. The diaphragm according to the invention is characterized in that a reinforcing element is associated with a microporous membrane by integrating it with the anode face of the said membrane. The novel diaphragms are particularly suitable for use in the electrolysis of alkali chlorides.

17 Claims, No Drawings

METHOD OF MAKING POROUS PLASTIC DIAPHRAGMS AND THE RESULTING NOVEL DIAPHRAGMS

This is a continuation of application Ser. No. 686,723, filed May 17, 1976, now abandoned.

BACKGROUND OF THE INVENTION

The present invention relates to a novel diaphragm, particularly for use in electrolysis cells, and to a novel method of making said diaphragm. The invention is an improvement in the diaphragm disclosed in our parent U.S. patent application, Ser. No. 469,808, filed May 14, 1974, commonly owned, now U.S. Pat. No. 3,980,613.

Our parent copending application, Ser. No. 469,808, describes a method of making porous diaphragms of asbestos which is deposited and consolidated by a fluorinated polymeric resin, characterized in that a stable, homogeneous suspension is formed by adding a fluorinated polymeric resin latex and a pore-forming agent to a suspension of asbestos fibers in water, in the presence of a sulphonic anionic surfactant, followed by placing said suspension in a filtration mold, drying and fritting the resulting casting at a temperature above the crystalline melting point of said fluorinated polymeric resin, and with the pore-forming agent being finally eliminated by decomposition or chemical action.

One of the requirements of the diaphragm of an electrolytic cell is that it behave as a porous medium: (1) on the one hand, it allows current to flow with a slight ohmic drop, and on the other hand, (2) it permits an even flow of electrolyte from one compartment of an electrolytic cell to the other. There is, consequently, a combination of mechanical, electrical and hydraulic conditions which are all the more critical now that electrolytic cells are required to function with high current density, subject to tolerating prohibitive ohmic drops. The properties required are rather contradictory. Thus, from a mechanical point of view, the diaphragm must have a well-defined, relatively permanent geometry or shape. The diaphragm must not be subject to swelling and being permanently deformed during use. In other words, such a diaphragm must have good mechanical strength. However, it must also have good wettability properties, enabling gases to be released and electrolyte to be circulated, while preventing diffusion of hydroxide ions in the opposite direction to the liquid flow. Such diffusion is responsible for the formation of chlorate which leads to a drop in yield.

To express the situation differently, a diaphragm for electrolysis must have low relative resistance. Relative resistance is understood as being the quotient of the resistance of a medium consisting of the diaphragm impregnated with electrolyte and the resistance of the same medium consisting of electrolyte. It has been observed that the relative resistance is bound up with the porosity of the diaphragm, but also with the shape of the flow passages.

Attempts have therefore been made to associate a plurality of elements so as to meet all the above requirements simultaneously. Thus, U.S. Pat. No. 3,694,281 proposes forming a mechanical support consisting of plastic filaments and arranged on at least one face of the diaphragm, or making a laminate with threads, fibers or particles inserted in the interface between the asbestos and the substrate.

French Pat. No. 2,170,247 proposes a simple arrangement which makes use of a support consisting of a cloth, e.g., of polypropylene.

Belgain Pat. No. 814,510 proposes improving the rigidity of a diaphragm by applying the diaphragm to at least one sheet of chrysotile asbestos. In a special embodiment of the diaphragm, the sheet comprising the diaphragm is sandwiched between and bonded to two sheets of chrysotile asbestos.

However, the main difficulty encountered in providing a preferred diaphragm is to maintain the advantages of an open structure as provided by the diaphragm produced in accordance with our prior copending patent application, Ser. No. 469,808, while improving its mechanical properties. When such diaphragms are used industrially, they are in fact found to have the disadvantage of showing structural deformation, particularly localized loss of cohesion, and to result in performance which cannot be perfectly reproduced.

It has been found that this defect can be avoided if the diaphragm obtained according to our prior copending application, Ser. No. 469,808, is associated with a reinforcing element, by integrating it with the anode face of the porous membrane, the reinforcing element having a structure which is at least as open, relative to the passage of liquid during electrolysis, as the porous membrane.

It is, accordingly, an object of the present invention to provide an improved diaphragm over that disclosed in our prior copending application, Ser. No. 469,808.

It is also an object of the present invention to provide an improved process for producing electrolytic cell diaphragms which are superior to those disclosed in our said prior copending application, Ser. No. 469,808.

Other objects will be apparent to those skilled in the art from the present specification.

GENERAL DESCRIPTION OF THE INVENTION

In its general aspects, the present invention comprises an electrolytic cell diaphragm in accordance with our copending application, Ser. No. 469,808, which has associated with it a reinforcing element integrated with the anode face of the porous electrolytic cell diaphragm. The reinforcing element shall have a structure which is at least as open or porous relative to the passage of liquid during electrolysis as the porous membrane.

It has unexpectedly been observed that if the same reinforcing element is placed on the cathode face rather than the anode face, the above-mentioned disadvantages of the prior art membranes will still be experienced.

The reinforcing element quite simply comprises a cloth or sheet of asbestos fibers.

The asbestos cloth from 0.5 to 1 mm. thick and less than 500 grams per square meter in weight may advantageously be associated with a microporous membrane produced in accordance with our said copending application, Ser. No. 469,808, in which the proportion of charge of pore-forming agent relative to the weight of asbestos is at least about 100% and preferably between about 250 and 600%.

In a preferred embodiment the diaphragm according to the invention comprises as asbestos cloth from 0.5 to 1 mm., weighing less than 500 grams per square meter and incorporated in the anode face of a microporous membrane in which the proportion of charge comprising calcium carbonate or other solid mineral pore-forming agent, relative to the weight of asbestos, is from about 250 to 600%. The diaphragm has a relative resistance of less than 4, a liquid flow rate through the diaphragm of from about 0.25 to 0.02 ml./min./cm.$^2$ under 50 g./cm.$^2$ of liquid charge at 20° C., and a thickness of about 2.5 to 5 mm. and preferably from about 3 to 4 mm.

Such a diaphragm can be obtained by applying a method similar to that described in our said copending parent application.

In practice, an asbestos suspension is prepared by dispersing by agitation a mixture which contains (by weight):

1 part of asbestos
about 5 to 100 parts of water
about 0.015 to 0.1 part of anionic surfactant.

The asbestos used is preferably made up of 0.5 to 50 millimeter fibers. The surfactant, a sulfonic anionic surfactant and preferably a sodium sulphosuccinate, is used in pure form or in solution in alcohol. Vigorous agitation gives a stabel, well-dispersed asbestos suspension.

Other sulfonic anionic surfactants may be employed such as alkyl sulfonates, sulfosuccinates and sulfosuccinamates.

The latex of a fluorinated polymeric resin and the pore-forming agent are added to the suspension so as to give the following proportions by weight:

100 parts asbestos
about 60 to 200 parts of fluorinated polymeric resin, on dry basis
about 100 to 1400 parts of pore-forming agent.

Agitation is then continued for about 1 to 20 minutes, preferably 5 to 10 minutes, depending upon conditions employed, particularly of speed. The final concentration of the suspension may be adjusted by adding water, at the end of the agitation process, in proportions best adapted to the depositing conditions observed.

The latex of fluorinated polymeric resin, preferably of polytetrafluoroethylene, is preferably a suspension of approximately 60% polytetrafluoroethylene in water. It may be replaced by other latices of fluorinated resins (a polymerized mixture of tetrafluoroethylene-hexafluoropropylene, or polymerized polychlorotrifluoroethylene etc.).

The pore-forming agent used is desirably a mineral material and may be calcium carbonate, colloidal alumina, metal oxides or any substances adapted to be eliminated by a solvent or by destruction at the end of the operation. It must have a well-defined particle size. It is preferable to use a calcium carbonate consisting of particles with an average diameter of 2 to 25 microns.

When a flat diaphragm is being made, the stable, homogeneous mixture of the various constituents is poured onto the reinforcing element in a quantity such that the dsired thickness is obtained. It is then filtered under vacuum then dried. Drying takes place at a temperature of over 100° C., at approximately 150° C. for 3 to 24 hours.

The sheet of then fritted or sintered by placing it in a furnace at a temperature above the crystalline melting point of the fluorinated polymer resin, preferably about 25° to 75° C. above it, for a period of 2 to 20 minutes and preferably about 6 to 10 minutes. The optimum temperature chosen depends somewhat on the fritting time but also on the thickness and composition of the diaphragm.

When the diaphragm has cooled and employs calcium carbonate as the pore-forming agent, it is immersed in a 10 to 20% by weight aqueous solution of a weak acid, in the presence of a wetting agent, for a period ranging from 24 to 72 hours depending on the thickness. Acetic acid is preferred, but other weak acids may be used with the same degree of success. Where other pore-forming agents are employed, another suitable solvent or reagent for decomposing and dissolving the pore-forming agent may be employed. Thus, depending upon the pore-former employed, any agent which will dissolve or decompose the pore-former may be employed, provided it does not dissolve or decompose the fluorinated polymer resin. If the mineral pore-former is alumina, acid or alkali solutions may be employed. With other metal oxides, other dissolving agents well known to the chemist may be employed.

The diaphragm obtained is then wased in water to eliminate the acid, and kept under water.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow and throughout the specification, the quantities of material are expressed in terms of parts by weight, unless otherwise specified.

EXAMPLE 1

This example is a control experiment which differs from the method of the invention, in that the reinforcing element is arranged on the cathode face of the diaphragm.

In this experiment, a suspension of asbestos fibers is prepared, containing:

100 g. of asbestos fibers of an average length of 1 to 2 mm.
2500 g. of water
2.5 g. of a 75% solution of sodium dioctylsulphosuccinate in alcohol.

Dispersion is effected by agitating for 60 minutes using an agitator of the drum roller type.

The following are then added:

300 g. of polytetrafluoroethylene polymer in the form of a latex with 60% of dry polymer
560 g. of calcium carbonate, marketed under the registered trademark "BLE OMYA".

The mixture is agitated for 5 minutes.

170 g. of the suspension is drained on an asbestos cloth measuring 1 square decimeter, using the following vacuum program:

1 minute of decantation.
2 minutes at a pressure of 200 m. of Hg. (mercury)
2 minutes at 300 mm. of Hg.
10 minutes at 740 mm. of Hg.

The asbestos cloth used has a thickness of 0.76 mm. for a weight of 255 grams per square meter. It comprises wrap and weft threads of 111 tex (weight in grams of 1,000 meters of thread) and has 13 threads/cm. in the wrap and 7 threads/cm. in the weft.

The form obtained, thus combined with the asbestos cloth, is dried in an oven at 150° C. for 5 hours. The reinforced from is then fritted in a furnace which is brought to 360° C. for 7 minutes. The carbonate is eliminated in a 20% by weight solution of acetic acid in water for 72 hours. The diaphragm thus obtained is washed with water.

This gives a diaphragm which has the following properties:

| | |
|---|---|
| weight in grams per square decimeter | 170 |
| thickness in mm. | 3.55 |
| liquid flow rate in ml./min./cm$^2$ (under a charge of 50 g./cm.$^2$) | 0.15 |
| relative reistance R/Ro | 2.6 |

The diaphragm is used as a separator in electrolysis of a solution of sodium chloride under the following conditions:

asbestos cloth placed at cathode side
electrodes formed by a grating (platinum-plated titanium at anode side and iron at cathode side) 7 mm. apart.
current density—25 amperes per square decimeter
temperature—85° C.

The following properties are observed during operation of the cell;

loss of cohesion on the anode face
tension of cell in equilibrium 3.44 volts
composition of liquor:
soda g./l."125
chlorate g./l.=1
liquid charge on diaphragm=15 cm. water (H)

EXAMPLE 2

This example is identical with the previous one, except that the same asbestos cloth is arranged at the anode side.

The liquor is found to have the same composition of soda and chlorate, but the equilibrium tension is found to have decreased to 3.17 volts; relative resistance is 2.1 and the liquid charge on the diaphragm is 12 cm. of water.

EXAMPLES 3 to 14

In all these examples the proportions of the various constituents are as follows:

| | |
|---|---|
| asbestos fibers | 100 g. |
| water | 2500 g. |
| polytetrafluoroethylene resin | 300 g. |
| sodium dioctylsulphosuccinate | 2.5 g. |

The other conditions and the results in electrolysis under the same conditions as in Examples 1 and 2 are set forth in the table which follows.

| EX. | $CaCO_3$ in g. | quantity of material filtered in g/dm.$^2$ | Thickness of diaphragm in mm. | Liquid flow rate ml./min./cm$^2$ under 50 g./cm.$^2$ | R/Ro | Tension of cell volts | H | Na OH g/l. | Na $ClO_3$ g/l. |
|---|---|---|---|---|---|---|---|---|---|
| 3 | 1120 | 160 | 4.8 | 0.21 | 1.9 | 3.37 | 7 | 125 | 0.8 |
| 4 | 560 | 140 | 3.1 | 0.23 | 2.9 | 3.15 | 6 | 120 | 1.3 |
| 5 | 560 | 200 | 5.1 | 0.14 | 2.6 | 3.32 | 24 | 140 | 0.9 |
| 6 | 280 | 160 | 3.3 | 0.09 | 3.6 | 3.18 | 18 | 120 | 2.0 |
| 7 | 280 | 190 | 3.5 | 0.05 | 2.9 | 3.19 | 25 | 135 | 1.2 |
| 8 | 280 | 220 | 3.7 | 0.025 | 3.0 | 3.35 | 54 | 125 | 0.4 |
| 9 | 140 | 160 | 2.4 | 0.10 | 3.7 | 3.19 | 20 | 108 | 3.0 |
| 10 | 140 | 190 | 2.8 | 0.01 | 4.1 | 3.37 | 115 | 125 | 1.9 |
| 11 | 140 | 220 | 3.4 | 0.005 | 4.0 | — | too great | — | — |
| 12 | 0 | 160 | 2.5 | 0.05 | 7.5 | 3.26 | 90 | 100 | 2.0 |
| 13 | 0 | 190 | 3.4 | 0.007 | 10.8 | — | too great | — | — |
| 14 | 0 | 220 | 3.6 | 0.001 | 49 | — | too great | — | — |

The foregoing table shows the properties and advantages of the diaphragm according to the invention.

Thus, it will be noted that the charge values for Examples 10 to 14 are very high or too great, making the diaphragms virtually useless in electrolysis.

Number 9 is an example of a diaphragm which tolerates a high proportion of chlorate, thus making it unsuitable.

The examples show that a diaphragm structure which is too closed gives poor results in electrolysis.

Conversely, too open a structure leads to fairly good results in electrolysis, but the diaphragm obtained is fragile, which means that a thicker diaphragm has to be used; this is detrimental to application in electrolysis, as can be seen from Example 3.

It will be seen from Examples 4 to 8 that there is a preferred range which gives an excellent overall result.

EXAMPLE 15

This example is carried out under the same conditions as previously and in the preferred range as defined above. It illustrates an experiment with a reinforcing element on the cathode face, different from that described in Example 1.

In this example, the charge of pore-forming agent ($CaCO_3$) is 560 g. and the quantity of material filtered 120 g.

The thickness of the diaphragm is 3.10 mm.

Relative resistance is 2.25, tension in equilibrium is 3.30 volts, the liquid charge, H, is 2.5 cm. and the composition of the liquor:

soda=116 g./l.
chlorate=1.7 g./l.

These conditions are unacceptable in electrolysis; the liquid charge is too small and the chlorate content too high. Moreover, it will be noted, e.g., that the tension of the cell corresponds to that in Example 5, where the quantity of material filtered is 200 g., the liquid charge 24, and the quantity of chlorate 0.9.

It has been seen that the solution comprising increasing the quantity of solid in the porous membrane to obtain a lower chlorate content and an adequate liquid charge leads to a high equilibrium tension, whereas according to the invention with a larger quantity of filtered material, 140 g. instead of 120 g. (see Example 4), the liquid charge on the diaphragm is greater, the proportion of chlorate reduced, and the tension of the cell weaker.

Even with a larger quantity of pore-forming filler, better results are obtained in electrolysis (Examples 2 and 3).

The examples thus illustrate the new and advantageous effects of the invention, such as the absence of any loss of cohesion and the very marked improvement in performance in electrolysis.

It should also be pointed out that the following effects are observed with diaphragms according to the invention:

(1) the diaphragms of the invention have greater resistance, at the anode side, to abrasion by gases;

(2) the diaphragms of the invention have greater resistance to bending and punching, operations which are sometimes necessitated by cell technology; they are also less vulnerable to handling, particularly during the shaping or forming of the diaphragms;

(3) in situ clearing operations are facilitated.

Above all, it should be noted that, in contrast with what usually happens, the mechanical, hydrodynamic and electrochemical requirements of electrolysis are all unexpectedly met better by diaphragms according to the invention.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrolytic cell for the electrolysis of alkali chlorides, said electrolytic cell being equipped with anodes and cathodes, having interposed between said anodes and cathodes porous diaphragms consisting of an asbestos cloth of from about 0.5 to 1 millimeter thick, weighing less than about 500 grams per square meter, integrated with the anode face of a microporous, uniform membrane of substantially uniform pore size and comprising asbestos fibers, said membrane, being consolidated by a fluorinated polymer resin, said asbestos fibers of between about 0.5 and 50 millimeters in length, said diaphragm having a relative resistance less than about 4, a flow rate of liquid through the diaphragm of from about 0.25 to 0.02 milliliters per minute per square centimeter under 50 grams per square centimeter of liquid charge at 20° C. and said diaphragm being of total thickness of from about 2.5 to 5 millimeters.

2. A method of manufacturing porous electrolytic cell diaphragms which are consolidated by a fluorinated polymer resin, comprising agitating a suspension of asbestos fibers in water, a sulfonic anionic surfactant, a fluorinated polymer resin latex and a solid mineral pore-former, to form a stable, homogeneous suspension, depositing and filtering said suspension on an asbestos cloth reinforcing element to form a preform, drying the resulting preform, sintering the said fluorinated polymer resin by heat at a temperature above the crystalline melting point of said fluorinated polymer resin, removing said solid mineral pore-former to form a uniform, porous membrane having uniform pore size, integrated on its anode face to said asbestos cloth reinforcing element, wherein said asbestos cloth reinforcing element has a structure which is at least as open with respect to the passage of liquor as said uniform, porous, homogeneous membrane.

3. A method of manufacturing a porous diaphragm according to claim 2, wherein said asbestos cloth reinforcing element comprises an asbestos cloth from about 0.5 to 1 mm. thick and weighing less than 500 grams per square meter.

4. A method of manufacturing a porous diaphragm according to claim 2, wherein said uniform, porous, homogeneous membrane, with which the said asbestos cloth reinforcing element is combined, employs a proportion of said solid mineral pore-former relative to the weight of asbestos of over about 100%.

5. A method of manufacturing a porous diaphragm according to claim 2, wherein said uniform, porous, homogeneous membrane, with which the said asbestos cloth reinforcing element is combined, employs a proportion of said solid mineral pore-former relative to the weight of asbestos of between about 250 and 600%.

6. A method of manufacturing a porous diaphragm according to claim 2, wherein said surfactant is sodium dioctyl sulphosuccinate.

7. A method of manufacturing a porous diaphragm according to claim 2, wherein said solid mineral pore-former is calcium carbonate.

8. A method of manufacturing a porous diaphragm according to claim 2, characterized in that the fluorinated polymer resin latex is of polytetrafluoroethylene polymer.

9. A method according to claim 2, wherein said asbestos fibers are of 0.5 to 50 millimeters in length.

10. A method according to claim 2, wherein said solid mineral pore-former is a member selected from the group consisting of calcium carbonate, colloidal alumina and metallic oxides.

11. A method according to claim 2, wherein said sulfonic anionic surfactant is a member selected from the group consisting of an alkyl sulfonate, sulfosuccinate and sulfosuccinamate.

12. A method according to claim 2, wherein said sintering of the preform is by heat and is effected for a period of about 2 to 20 minutes.

13. A method according to claim 2, wherein said solid mineral pore-former is removed by decomposition.

14. A method according to claim 2, wherein the said solid mineral pore-former is removed by extraction.

15. An integrated, porous disphragm suitable for use in an electrolytic cell consisting of an asbestos cloth of from about 0.5 to 1 millimeters thick, weighing less than about 500 grams per square meter, integrated with the anode face of a microporous, uniform membrane of substantially uniform pore size and comprising asbestos fibers, said membrane, being consolidated by a fluorinated polymer resin, said asbestos fibers of between about 0.5 and 50 millimeters in length, said diaphragm having a relative resistance less than about 4, a flow rate of liquid through the diaphragm of from about 0.25 to 0.02 milliliters per minute per square centimeter under 50 grams per square centimeter of liquid charge at 20° C. and said resulting diaphragm being of total thickness of from about 2.5 to 5 millimeters.

16. An integrated, porous diaphragm according to claim 15, wherein said total thickness of said diaphragm is between about 3 and 4 millimeters.

17. An integrated, porous diaphragm according to claim 15, wherein the fluorinated polymer resin is polytetrafluoroethylene polymer.

* * * * *

UNITED STATES PATENT AND TRADEMARK OFFICE

CERTIFICATE OF CORRECTION

PATENT NO. : 4,204,938

DATED : May 27, 1980

INVENTOR(S) : Jean Bachot et al.

It is certified that error appears in the above-identified patent and that said Letters Patent are hereby corrected as shown below:

Col. 3, line 20, delete "stabel" and replace with -- stable --.

Col. 3, line 55, delete "dsired" and replace with -- desired --.

Col. 3, line 59, delete "of" and replace with -- is --.

Col. 4, line 15, delete "wased" and replace with -- washed --.

Col. 4, line 59, delete "wrap" and replace with -- warp --.

Col. 4, line 61, delete "wrap" and replace with -- warp --.

Col. 5, line 48, delete "soda g./l."125 " and replace with -- soda g./l. = 125 --.

Signed and Sealed this

*Twelfth* Day of *August 1980*

[SEAL]

*Attest:*

SIDNEY A. DIAMOND

*Attesting Officer*

*Commissioner of Patents and Trademarks*